United States Patent [19]

Plischke et al.

[11] 4,293,614

[45] Oct. 6, 1981

[54] CRIMPED POLYESTER FILAMENT

[75] Inventors: LeMoyne W. Plischke; Harold M. Familant, both of Pensacola; Darrell A. Kelly, Milton, all of Fla.

[73] Assignee: Monsanto Company, St. Louis, Mo.

[21] Appl. No.: 90,823

[22] Filed: Nov. 2, 1979

[51] Int. Cl.[3] ..... D02G 3/00

[52] U.S. Cl. ..... 428/370; 264/171; 428/372; 428/374; 428/397

[58] Field of Search ..... 428/362, 369, 370, 373, 428/374, 397, 372; 264/171, 168; 260/40 P

[56] References Cited

U.S. PATENT DOCUMENTS

| | | | |
|---|---|---|---|
| 3,497,585 | 2/1970 | Chapman et al. | 264/171 |
| 3,536,802 | 10/1970 | Uraya et al. | 264/171 |
| 3,582,418 | 6/1971 | Schuur | 428/373 X |
| 3,671,379 | 6/1972 | Evans et al. | 264/171 X |

FOREIGN PATENT DOCUMENTS

| | | | |
|---|---|---|---|
| 45-1935 | 1/1970 | Japan | 428/370 |
| 1300014 | 12/1972 | United Kingdom | 264/171 |

*Primary Examiner*—Lorraine T. Kendell

[57] ABSTRACT

Crimped side-by-side bicomponent filaments consisting of a polyester and $CaF_2$ are produced in which the $CaF_2$ is dispersed in only one of the components.

4 Claims, No Drawings

CRIMPED POLYESTER FILAMENT

BACKGROUND OF THE INVENTION

A. Field of the Invention

This invention relates to a novel crimped bicomponent filament prepared by conjugately melt spinning in a side-by-side relation polyester component, one of which contains $CaF_2$ uniformly dispersed therein.

B. Description of the Prior Art

It is known that crimped filaments are obtained by conjugately melt spinning in a side-by-side relation two different polymers having different shrinkage properties or two chemically identical polymers having different thermal histories and, thus, different shrinkage properties. The structural heterogeneity (i.e. difference in shrinkage) in the cross-section of these filaments creates internal stresses which produce helical crimp when they are relieved. Filaments having internal stresses which when relieved produce crimp are said to have latent crimp. There are certain drawbacks involved in producing these prior art filaments, for example, one of the filaments requires the spinning of two chemically different polymers while the other filament requires subjecting each polymer to different thermal treatments just prior to melt spinning.

SUMMARY OF THE INVENTION

In accordance with the present invention a melt spun crimped side-by-side bicomponent filament is provided consisting essentially of a polyester and $CaF_2$ and having a crimp level of a least 5 crimps per inch (197 crimps per meter) wherein the $CaF_2$ is uniformly dispersed in one of the components at a concentration of at least 200 ppm by weight of said one component and the weight ratio of the $CaF_2$-containing component to the other component is 5:95 to 70:30. The filaments may be produced by conjugately melt spinning two polyesters of the same chemical structure in a side-by-side relation to form filaments that are withdrawn from the spinneret and collected in a conventional manner, wherein: one of the polyesters contain at least 200 ppm, based on the weight of the said one polyester, of $CaF_2$ uniformly dispersed therein; the weight ratio of the $CaF_2$-containing component to the other component is in the range of 5:95 to 70:30, respectively; and the ratio of the components, the amount of $CaF_2$ in the $CaF_2$-containing component and the speed at which the filaments are withdrawn from the spinneret (referred to herein as "drawing-off speed") are correlated to provide filaments having a crimp level of at least 5 crimps per inch (197 cpm) and, preferably, 10 crimps per inch (394 cpm). Surprisingly, crimp develops in the filaments during melt spinning just below the spinneret.

The filaments are generally useful in producing textile fabrics where a soft hand is desirable, such as, apparel and carpet fabrics.

Crimp level is expressed herein in terms of crimps per inch (or meter) of filament length, the filament length being measured while the filament is under no tension (i.e. while the length of the filament is in a nonextended form as opposed to an extended form where the filament is straight and the crimp removed).

PREFERRED EMBODIMENTS OF THE INVENTION

The side-by-side bicomponent filaments of the present invention may be produced by conventional conjugate spinning techniques using commercially available spinning equipment deigned for this purpose, wherein each component is subjected to the same or substantially the same thermal treatment.

According to a preferred embodiment of the invention the components are separately melted and joined to form a stratified flow of melts which is then extruded through a spinneret assembly, without intimate mixing of the components, to form molten filaments which are withdrawn from the spinneret at a given rate (i.e. drawing-off speed). As the molten filaments move away from the spinneret they cool to form solid filaments and also attenuate (neck down) to a finer denier. Attenuation of the molten filaments imparts a jet stretch and molecular orientation thereto. The extrusion rate and drawing-off speed are adjusted (i.e. correlated) to provide filaments of a desired denier.

Several processing variables have been observed to have an influence on the crimp level of the filaments. The following discussion considers changing and/or the effect of only one variable at a time while leaving all other variables constant and has reference to using PET (polyethylene terephthalate) as the polyester.

$CaF_2$ Concentration

At concentrations of $CaF_2$ in the $CaF_2$-containing component below about 2000 ppm, lower concentrations require higher drawing-off speeds to achieve the same crimp level. Stated different as the $CaF_2$ concentration increases from a low level (e.g. 200 ppm), the crimp level also increases. However, increasing the $CaF_2$ concentration above the 2000 ppm will not further significantly increase the crimp level. Therefore, in the interest of cost savings, $CaF_2$ concentrations above about 2000 ppm are not recommended although, if desired, higher concentrations (e.g. 8,000 to 12,000 ppm or higher) may be used.

Component Ratio

The crimp level increases to a maximum level and thereafter decreases when the weight ratio of the components is varied from 0:100 to 100:0, with the highest crimp level being obtained with a weight ratio between 35:65 and 65:35, $CaF_2$-containing component to the other component. In general, in order to provide a filament having a crimp level of 5 cpi (197 cpm) or higher, the weight ratio of the components must be with the range of 5:95 to 70:30, $CaF_2$-containing component to the other component.

Drawing-Off Speed

In general, increasing the drawing-off speed increases the crimp level and reduces the denier of the filaments and also, of course, increases the molecular orientation of the filaments. Preferably, drawing-off speeds of at least 1500 ypm (1372 m/min), and most preferably at least 2500 ypm (2286 m/min), are used.

Quench

The use of a cross-flow of air to assist in cooling the molten streams tends to increase the crimp level of the resulting filaments. Generally, where a large number of filaments are being quenched, the freshly extruded filaments are solidified in a quenching chamber (chimney) positioned just below the spinneret through which the filaments are passed and subjected to the cross-flow of air.

Filament Cross-section

Higher crimp levels are obtained with filaments having a non-round cross-sectional shape, for example, filaments of a Y-shaped, trilobal-shaped or triskellion-shaped cross-section.

Fiber-forming polyesters which may be used in producing the filaments of the invention are those fiber-forming polyesters formed from one or more of the glycols, e.g. $HO(CH_2)_nOH$; where n=2 to 10, with one or more dicarboxylic acids or ester-forming derivatives thereof (e.g. terphthalic acid or dimethylterephthalate), and copolyesters or modifications of these polyesters and copolyesters (e.g. modification with an alkoxypolyalkylene glycol). Examples of such polyesters include polyethylene terephthalate, polybutylene terephthalate and PET modified (6 mole %) with methoxy polyethylene glycol (MW~2,000).

EXAMPLE 1

This example illustrates a procedure for preparing $CaF_2$-containing polyester which may be suitably used in producing the filaments of the present invention.

$CaF_2$ was prepared by the addition of 685.3 grams (2.905 moles) of calcium bromide dihydrate to 546.9 grams (2.905 moles) of potassium fluoride dihydrate and 14061.29 grams of water to a stainless steel vessel equipped with a mechanical stirrer. The resulting aqueous $CaF_2$ slurry was stirred without interruption until it was ready for use so as to prevent $CaF_2$ from precipitating. The total weight of the slurry was 33.7 lbs (15.3 Kg).

PET chips of fiber grade were divided into two portions of equal weight. One of the portions was added to a twin-shell, cone-shaped blender along with 4,822 ppm, based on the weight of the portions, of $KF{\cdot}2H_2O$. The ingredients were then blended to provide PET chips coated with $KF{\cdot}2H_2O$. Then the other portion was coated with 6,043 ppm of $CaBr{\cdot}2H_2O$ by the same technique. The two portions were then both added to the blender and mixed together. When the resulting blended coated chips are melted with stirring, the $KF{\cdot}2H_2O$ reacts with the $CaBr{\cdot}2H_2O$ in the molten PET to provide molten PET containing 2000 ppm of $CaF_2$ uniformly dispersed therein. The resulting $CaF_2$-containing molten PET may then be directly fed to a conjugate melt spinning assembly where it is combined with molten PET and extruded to form filaments of the invention or it may be extruded into particulate form for subsequent use.

The amounts of ingredients may be varied to provide for different $CaF_2$ concentrations. Also, $CaF_2$-containing PET of a given $CaF_2$ concentration can be blended with appropriate amounts of PET to provide a desired $CaF_2$ concentration.

Other $CaF_2$-containing melt spinnable polyesters may be prepared by the procedure of this example by substituting such a polyester for PET.

EXAMPLE 2

This example illustrates the production of filaments of the present invention.

Two components were separately heated to 270° C. and melted, and conjugately spun at about 280° C. in a conjugate ratio of 1:1 (by weight) in a side-by-side relation through a 34-hole (triskellion-shaped) spinneret to obtain molten streams. One component (A) was PET modified to contain 1000 ppm of $CaF_2$ uniformly dispersed therein using the procedure described in Example 1 and the other compound (B) was simply PET (i.e. unmodified PET). The filaments were passed through a chimney positioned just below the spinneret in which they were subjected to a cross-flow of air (450 cfm, or 12.7 $m^3$/min) and quenched. The solidified filaments were withdrawn from the chimney at a rate (drawing-off speed) of 5000 ypm (4572 m/min). The resulting triskellion filaments had a crimp level in excess of 10 cpi.

We claim:

1. A melt spun filament having a crimp level of at least 5 crimps per inch and being composed of two polyester components arranged in a side-by-side relation, wherein the polyester of one component contains $CaF_2$ uniformly dispersed therein at a concentration of at least 200 parts per million based on the weight of the polyester of said component and the polyester of the other component contains no $CaF_2$ and wherein the weight ratio of the $CaF_2$-containing component to the other component is 5:95 to 70:30, said filament being characterized in that the polyester of both components is of the same chemical structure and thermal history.

2. The filament of claim 1 wherein the weight ratio is between 35:65 and 65:35.

3. The filament of claim 2 wherein the polyester is polyethylene terephthalate.

4. The filament of claim 3 having a crimp level of at least 10 crimps per inch.

* * * * *